US005509773A

United States Patent [19]

Connor et al.

[11] Patent Number: 5,509,773

[45] Date of Patent: Apr. 23, 1996

[54] MACHINE AND PROCESS FOR RECOVERING PHARMACEUTICAL PRODUCT

[75] Inventors: John J. Connor, Philadelphia; Klaus E. Gehlert, Holland, both of Pa.

[73] Assignee: Gemel Precision Tool Co., Inc., Ivyland, Pa.

[21] Appl. No.: 413,494

[22] Filed: Mar. 30, 1995

Related U.S. Application Data

[62] Division of Ser. No. 203,005, Feb. 28, 1994, Pat. No. 5,460,471.

[51] Int. Cl.[6] ..... B65B 69/00

[52] U.S. Cl. ..... 414/412; 414/786

[58] Field of Search ..... 414/404, 412, 414/417, 786, 798.1, 788.8, 794.8; 221/25, 30, 31, 290, 298

[56] References Cited

U.S. PATENT DOCUMENTS

| | | | |
|---|---|---|---|
| 3,027,021 | 3/1962 | Kramer | 414/788.8 |
| 4,036,380 | 7/1977 | Berry et al. | 414/412 |
| 4,428,709 | 1/1984 | Peters | 414/412 |
| 4,909,412 | 3/1990 | Cerf | 414/798.1 X |
| 4,909,414 | 3/1990 | Heath | 414/412 X |
| 4,946,339 | 8/1990 | Berg et al. | 414/412 X |
| 4,975,015 | 12/1990 | Harding | 414/412 |
| 5,119,969 | 6/1992 | Haber | 414/412 X |

OTHER PUBLICATIONS

De-blistering machine, Sepha Products, Newtownards, N. Ireland.

*Primary Examiner*—David A. Bucci
*Attorney, Agent, or Firm*—John J. Simkanich

[57] ABSTRACT

An apparatus for recovering pharmaceutical product from blister packs and a method for doing same is provided. Pharmaceutical product blister pack cards, which are unsuitable for sale, are straightened, if necessary, and stacked in a magazine. Individual blister cards are indexed from the magazine stack onto an operations chain conveyor at a loading station by a finger indexing subsystem. The chain conveyor carries the blister card to a cutting station where the back face of the card receives a peripheral cut at the location of each blister pocket and inside the wall of the pocket. The chain conveyor then carries the blister card to a punching station where each product on the card is forced through the back face of the card utilizing moving the respective cut section of the card back, thereby discharging the product into a collection bin. The emptied blister card is moved to a discharge region where it is separated from the chain conveyor. The operation of the entire machine is driven end timed from a single central drive motor. The number of moving parts in the machine is minimized.

20 Claims, 10 Drawing Sheets

PROCESS FOR RECOVERY OF PHARMACEUTICAL PRODUCT FROM BLISTER PACK CARDS

PROCESS FOR RECOVERY OF PHARMACEUTICAL PRODUCT FROM BLISTER PACK CARDS

Fig. 6a
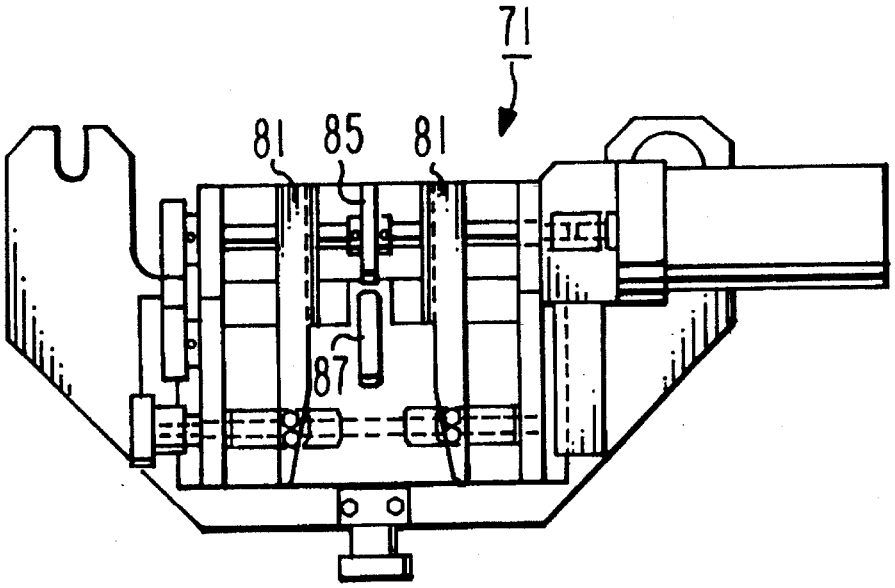
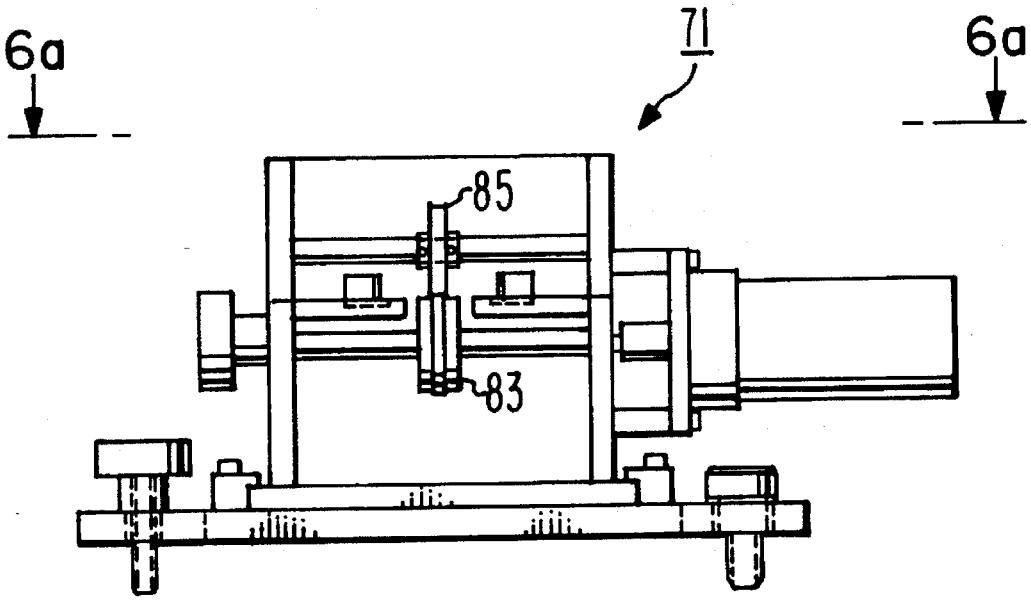
Fig. 6

Fig. 9
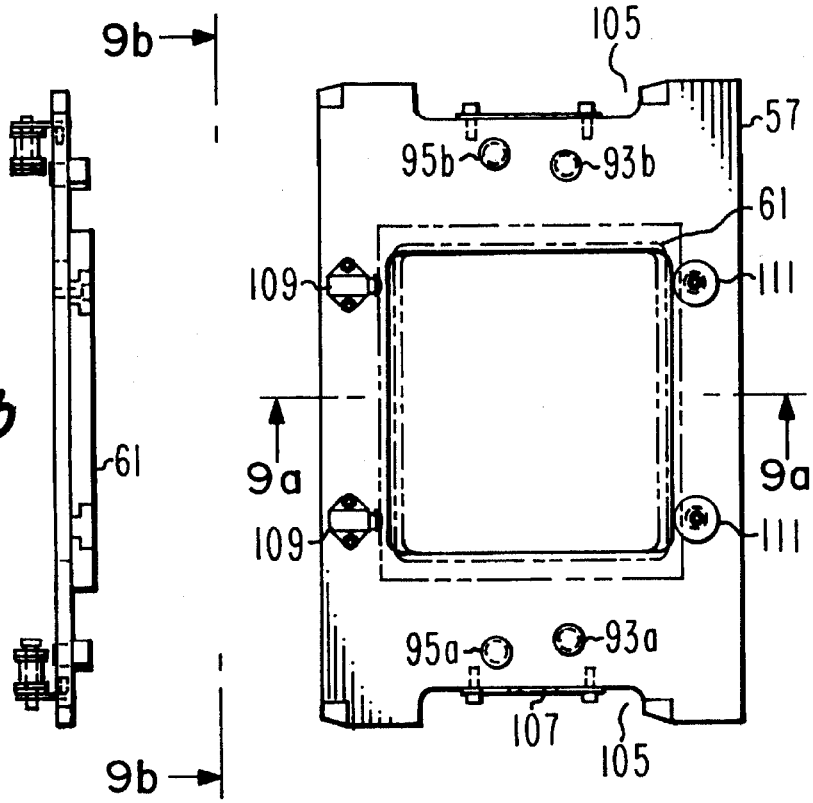
Fig. 9b
Fig. 9a
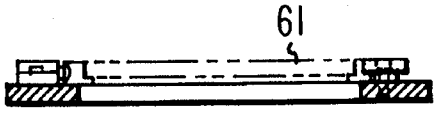
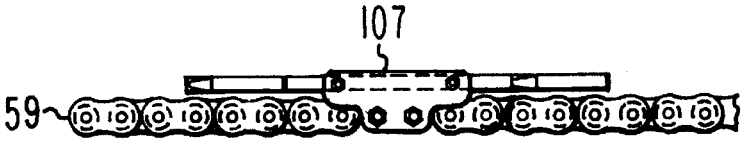
Fig. 9c

MACHINE AND PROCESS FOR RECOVERING PHARMACEUTICAL PRODUCT

This application is a division of U.S. application Ser. No. 08/203,005, filed Feb. 28, 1994, now U.S. Pat. No. 5,460,471.

BACKGROUND OF THE INVENTION

The present invention relates to an apparatus used for the rupturing of pharmaceutical product packages and the recovery of the product from the package waste. It also relates to the process of pharmaceutical product recovery from its packages. Specifically, the invention relates to a machine for recovering pharmaceutical product from blister packs without damage to that product, and relates to the process carried out in the operation of such a machine.

Pharmaceutical product, such as pills, gel caps, caplets and capsules, sold over the counter, are often packaged in individual pockets on cards. These are known as blister packs and allow the consumer to access one product unit at a time by rupturing an individual pocket. This packaging structure has now found very wide use in the marketplace as it protects the adjacent product from contamination until used, and also allows for a readily discernable count of remaining product vs. product taken.

Blister packaging of pharmaceutical product is presently being provided by automated packaging machinery, including automated filling devices. With increased production rates, increased production line speeds and new product shapes, sizes and coatings, "miss fills" and other blister packaging failures often occur. In some manufacturing lines, as much as 10 to 15 percent of the blister packages of pharmaceutical product are unsuitable for market. The pharmaceutical manufacturers are, therefore, desirous of recovering the miss-packaged product, in good condition for repackaging.

Recovery of this product was originally done by hand. Recently, a number of manufacturers have introduced machines which rupture the unsuitable blister packages and separate the product from the packaging. These manufacturers have included: Sepha Products, Newtownards, N. Ireland; Service Industries Midwest, Inc., Rolling Meadows, Ill.; RBP Maschinevertrieb GmbH, Monschau, Germany; and Roni/Craggs, Inc., Baltimore, Md.

Each manufacturer's design for its product recovery machine has differed, as has the respective machine's method of operation. However, each product recovery machine's design has addressed the same generic blister pack design. A typical, generic, pharmaceutical blister package is a rectangular card having a plurality of regularly spaced plastic product pockets extending upwardly from the card and forming a rectangular product matrix on the card. The card is usually serrated in a cross-hatched fashion to form a plurality of breakaway "cardettes" (i.e. card subsections) each carrying but a single product pocket.

These blister cards are typically made by sandwiching a foil backer material to a preformed plastic sheet carrying the desired plurality of preformed product pockets. Child resistant packages have a paper layer added to the outside of the foil which must be removed before the consumer can open the blister pack. Typically, after the individual product pockets have been loaded with individual product units, the foil backer material, which forms the back surface of the card, is heat sealed with the plastic sheet, either with or without the use of a bonding agent. The foil-to-plastic bond may or may not be technically knurled. Following the bonding, the cross-hatched serrations are cut into the flat card surface allowing a space of from about 0.05 inches to about 0.25 inches "wargin" between the product pocket wall and a serration. In the instance where the "cardettes" are rectangular, this margin is not uniform about the "cardette" but is equal for opposing edges of the "cardette".

The plastic sheet is Bade of poly vinyl chloride ("PVC") or other approved material and can vary in thickness from 0.004 inches to 0.010 inches, depending upon the size of the product pocket and the size, weight and strength of a product unit. The foil backer material is typically aluminum foil sheet of about 0.002 inches thickness. This foil is ruptured by the consumer who presses against the product pocket, distorting it and thereby pushing product unit through the foil to release it from the pocket.

When the serrations are cut in a card, the lateral serrations can be die cut first, and the longitudinal serrations can be die cut secondly, or the serrations can all be cut at once. A card is then fed "longitudinally" along the product flow path. With the lateral dimension of a blister pack card being shorter than the longitudinal dimension, a card is stiffer laterally than longitudinally, and will tend to curl along its longitudinal length.

The product pockets are die formed into the PVC sheet while it is in a softened state. These product pocket forming die(s) is(are) tapered so that the cross sectional dimensions of the pocket are larger at its base (where it meets the plane of the sheet) than at the closed end wall of the pocket. The pocket is slightly over sized to provide a space between the wall and a product unit to be carried by that pocket. This space is reasonably uniform about the perimeter of the product and can range from 0.005 inches to 0.075 inches, but is generally in the range of 0.020 to 0.040 inches.

Sepha Products provides a machine which uses a set of rollers to press tablets and capsules from push-through blister packs. The packs are fed from a magazine through the roller set. The product is them separated from the packaging waste material. When child resistant blister packs are involved, having a reinforced backer pull away layer adhered to the back of the blister pack, the blister packs are fed from a magazine stack to a horse-shoe cutting station where the base of the product pocket is cut thereby converting the child resistant pack to a push through pack. The blister pack is then fed through the same roller pair as before, which removes the product from the package by forcing back the wall of the product pocket and releasing the product. The maximum capacity of this machine is about 60 blister packs per minute for straight roller burst, and about 24 blister packs per minute for the pocket cut and roller burst operation.

Service Industries provides a machine which contains a cutting blade structure. This cutting blade simultaneously cuts open each product pocket on a blister pack. The blisters are then cammed open outwardly from the backer card and the product drops into a collection chute. The empty package is then ejected. The maximum capacity of this machine is about 20 blister packs per minute.

RBP provides a machine which processes up to about 30 blister packs per minute from a magazine. It utilizes a roller system, similar to the Sepha roller system, to burst the blister packs. The RBP machine then separates the product from the package waste with a screening operation. The RBP machine does not handle child resistant blister packs.

Roni/Craggs provides a machine which utilizes counter rotating profile rolls to burst the blister pack pockets. Each blister cup (product pocket) is scratched on a "certain spot" to weaken it. The rollers then press the product units through the weakened pocket (cup) wall and the blister pack waste is then separately discarded. Again, the maximum capacity of this machine is about 30 blister packs per minute.

These prior machines focus on single step or "fewer" step operation. They incorporate certain shortcomings into their designs and/or operation, these being: limited capacity, a tendency to Jam, a tendency to cut, bruise, break or otherwise injure product.

What is desired is to provide (1) a machine and a method of operation (process) for recovering product from pharmaceutical blister packs which has two to three times the capacity, or greater, of the previous machines.

What is also desired is to provide (2) such a machine which does not easily jam, and (3) which does not cut, bruise, break or injure the product.

What is further desired is to provide (4) such a machine which is easily changed over between various card sizes and product patterns; and (5) which does not require frequent adjustment, synchronization or timing correction.

SUMMARY OF THE INVENTION

The features of the present invention are realized in a machine for recovering product from pharmaceutical blister packs and its process of operation which yields increased capacity, enhanced product handling and reduced down time from jams and/or for adjustments.

The machine has a simple flow through operation implemented with a chain conveyor; is driven from a single motor source; and has three definable operating stations whose operations are indexed from the single drive source, which drive source also drives the chain conveyor. Moving parts are minimized and all movement of blister cards and of product is straight line movement. The chain conveyor path extends beyond the three operating stations to establish a change parts region up-line from the first operating station, and a blister card discharge region down-line from the third operating station.

The three operating stations, which are in straight line alignment with one another, are respectively, a blister card loading station, a card (backer) cutting station, and a punching/product discharge station. The central drive is coupled to the operating structure of each station so that the operation of each station is synchronized and operates in unison with the other operations of the machine.

The longitudinal curve which often occurs in a blister card is removed by a longitudinal rib formed along the center line of the card by a roll crimper. This straightening operation is ancillary to the three basic operating stations of the machine. It is also driven by a separate motor source.

The chain conveyor is built from a series of connected identically sized rectangular carrier plates. The width of these carrier plates establishing the width of the belt, and the length of these plates establishing the indexed distance of movement for the belt in the repetitive operation of the machine. Each carrier plate receives a "nest plate" which is the change part for the chain conveyor as it is intended to receive and hold a blister card.

Two sets of paired roller cams are positioned on the upper face of each carrier plate. These cams comprise a leading pair of cams, positioned one either side of the nest plate position, and a follower pair of cams likewise positioned outboard of the nest plate position and behind the leading pair with respect to the direction of travel of the carrier plate. These cam pairs operate two sets of paired indexing fingers which form a finger indexing subsystem at the card loading station.

The card loading station includes a vertical standing magazine in which cards are stacked positioned below this magazine, to intercept its discharge, are two pairs of juxtaposed indexing lingers. The first set of juxtaposed indexing fingers is the "lower" indexing finger pair which id normally biased to the extended position (extended towards one another to intercept end hold a card). The second set of these indexing fingers Is the "upper" indexing finger pair which is normally biased to the retracted position (retracted away from one another to allow a card to pass). Each indexing finger incorporates a ramp shaped, caming surface on its lower face. This caming surface is operated upon by a respective carrier plate roller cam which interaction controls the operation of the fingers.

The card (backer, i.e. back face) cutting station has a female die fixedly positioned above the conveyor line. A cutting die is raised from below the conveyor line to operate upon a card held in a chain conveyor nest plate which is temporarily positioned at the station. The movement of the cutting die raises the card out of the nest plate and into the female die whereupon the cutting die continues its movement to cut through the back face of the card and slightly into the base of each product pocket. The cutting die is then retracted which positively draws the card downward out of the female die and back onto the nest plate. Thereafter its vertical movement is abated as the cutting die continues to retract downwardly.

The punching or product discharge station has a male die fixedly positioned above the conveyor line. This male punching die carries a rectangular knock out plate or individual punches depending upon the product being operated upon. The female die comprising a guide block carrying a plurality of straight punch through holes is raised from below the conveyor line to intercept a nest plate and to raise above the nest plate thereby raising the pre-cut card carried thereon into contact with the knock out plate or punches of the upper male die. This causes the plastic pockets to collapse and the product held therein to be forced downwardly forcing open the cut flap(s) in the back face of the card, thereby discharging the product through the openings in the female die to a collection point below.

The moving die members for Moth the cutting station and the punching/product discharge station are mounted on the same operating table. This table's travel and position is cam controlled. This cam is driven off the central drive of the machine. The throw of the table is adjustable.

DESCRIPTION OF THE DRAWINGS

The features, advantages and operation of the present invention will be better understood from a reading of the following detailed description of the invention, An conjunction with the following drawings, in which like numerals refer to like elements end in which:

FIG. 6 is an enlarged detail view of the rib crimper;

FIG. 6*a* is a plan view of the rib crimper of FIG. 6;

FIG. 9 is a plan view of a chain conveyor carrier plate with a nesting plate installed thereon;

FIGS. 9*a* and 9*b* are side views of the carrier plate assembly of FIG. 9 taken as shown in that figure;

FIG. 9*c* is a detail of the carrier plate to sprocket chain link up;

DETAILED DESCRIPTION OF THE INVENTION

Figure 1:
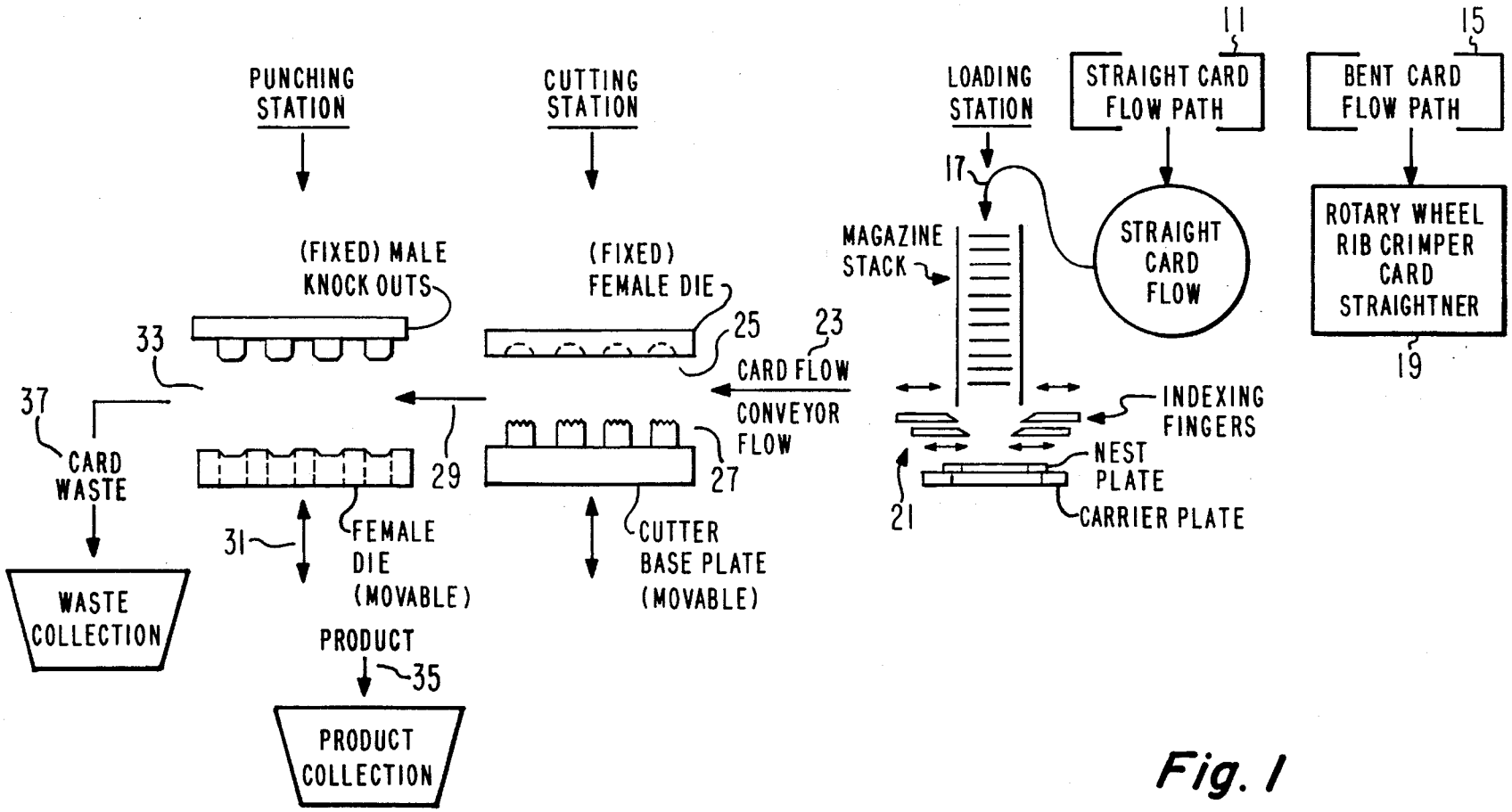
FIG. 1 is a block diagram for the process carried out by the invention in recovering pharmaceutical product from blister cards.

The recovery of pharmaceutical product from blister pack cards may be accomplished by the process of FIG. 1. Unmarketable blister packs are received from a production line or other source. These cards may be sorted into straight cards in a flow path 11, or in bent cards in a bent card flow path 15. The straight cards are loaded 17 directly into a retention device such as a vertical standing magazine. The bent cards are straightened 19, before loading 17 into the retention device. This straightening 19 may be accomplished by forming one or more ribs in the face of the card.

Cards are drawn from the magazine singly, in sequential order 21. This may be accomplished by an indexing structure which permits one card at a time to fall from the magazine on to an awaiting conveyor structure. This conveyor structure carries 23 each card away from the magazine to a cutting station, where the travel of the conveyor is temporarily halted 25. At this cutting station a cutter assembly is raised to cut 27 into the back of the card and through the back face. This is accomplished by the cutter assembly carrying the card onto a female die containing a plurality of cavities, one for each blister pocket on said card, where the die face stops the card and the cutters puncture the back of the card thereby traveling partially into the die cavities.

Conveyor movement As then re-initiated 29 and the cut card is carried by the conveyor structure to a punching station where conveyor movement is again halted. At this punching station a female die containing a plurality of portals, one for each product unit to pass, is raised to meet a fixed knock out plate. This operation forces 33 the product through the back face of the card end thereafter falls through said female die portals to a collection station 35. Conveyor movement thereafter continues and the card drops off the conveyor 37 into waste collection as the conveyor begins its return.

Figure 2:
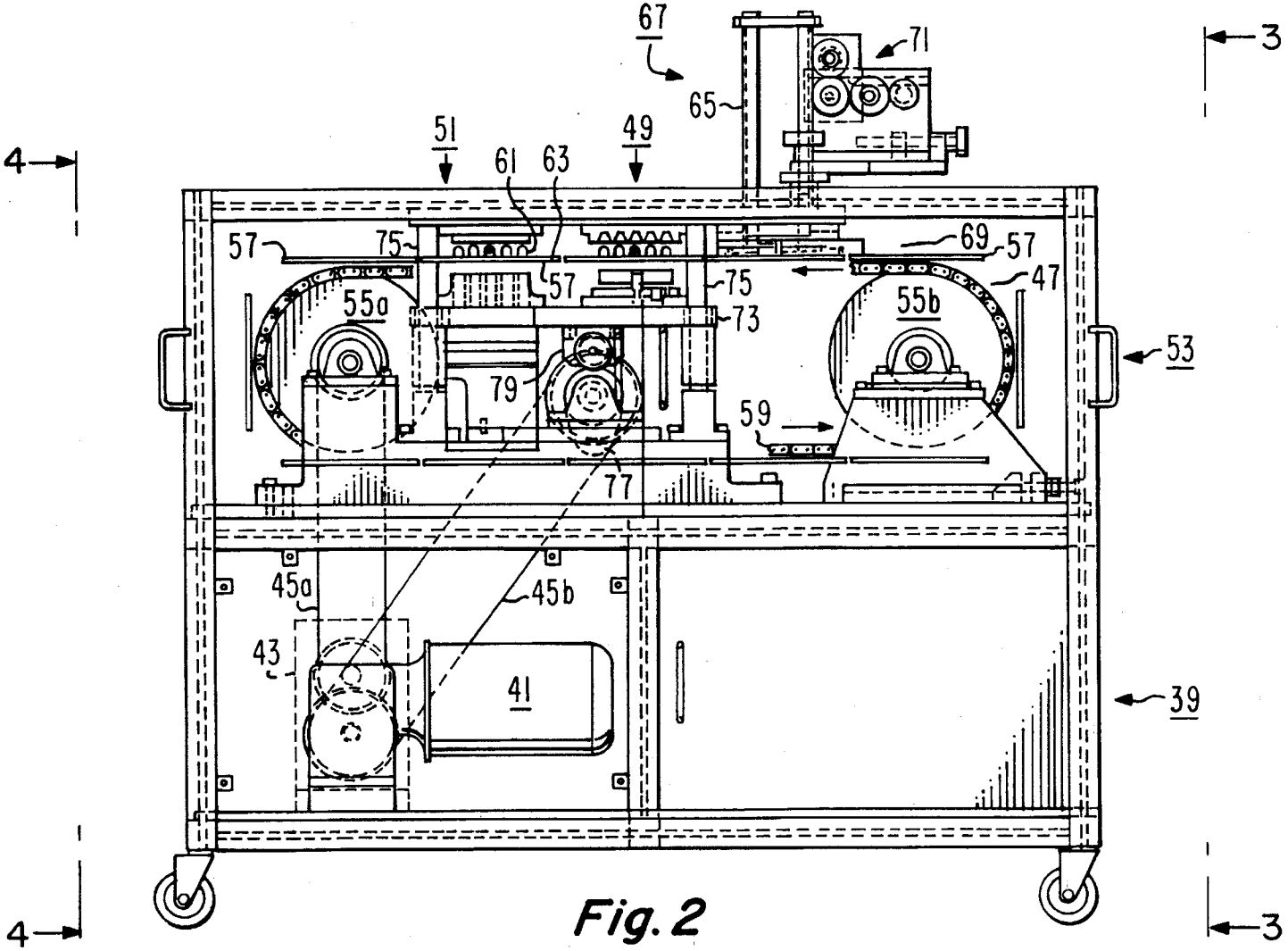
FIG. 2 is a front view of the machine assembly of the present invention.

This process is performed by the machine apparatus shown in FIG. 2. The apparatus has a lower portion 39, which is essentially a cart, houses the single electric drive motor 41, a Geneva type timing transmission 43, the drive belts/chains 45*a*, 45*b* for the conveyor 47 operation and the cutting station 49 and the punching station 51 operations.

The upper portion 53 houses a sprocket chain conveyor 47 which operates horizontally down the length of the machine. This conveyor has at least a drive sprocket 55*a* at a first end, which is connected to the drive chain 45*a*, and a follower sprocket 55*b* at the other end of the conveyor 47.

The conveyor 47 is made up of a plurality of flat rectangular carrier plates 57 linked between the two side sprocket chains 59. Each carrier plate 57 holds a nest plate 61 which in turn holds a blister card 63.

Blister cards 63 are held in a vertically standing magazine 65 positioned at the up line end of the machine established as the loading station 67. A finger indexing subsystem 69 loads one card at a time from the magazine 65 on to the conveyor 47, nest plate 61.

A card straightening assembly 71 operates ancillary to the main functions of the machine but provides a valuable and necessary function as the straightness of each card bears upon the performance of the machine. This straightening assembly 71, which contains a plurality of drive wheels and a pair of machine working wheels, imparts a bend in the back face of the card in the shape of a raised rib like crimp.

Cutting station 49 and the punching station 51 each utilize a stationary die and a moving die, the moving dies for each station 49, 51 are mounted to a commonly shared movable shuttle plate 73 which is guided for operation by four vertically extending guide rods 75. The shuttle plate 73 is caused to raise and lower by the operation of an eccentric cam 77 which is caused to rotate on its own shaft by the chain drive 45*b*. A cam follower, having a bracket and a wheel, is mounted to the bottom of the shuttle plate 73.

Figure 3:
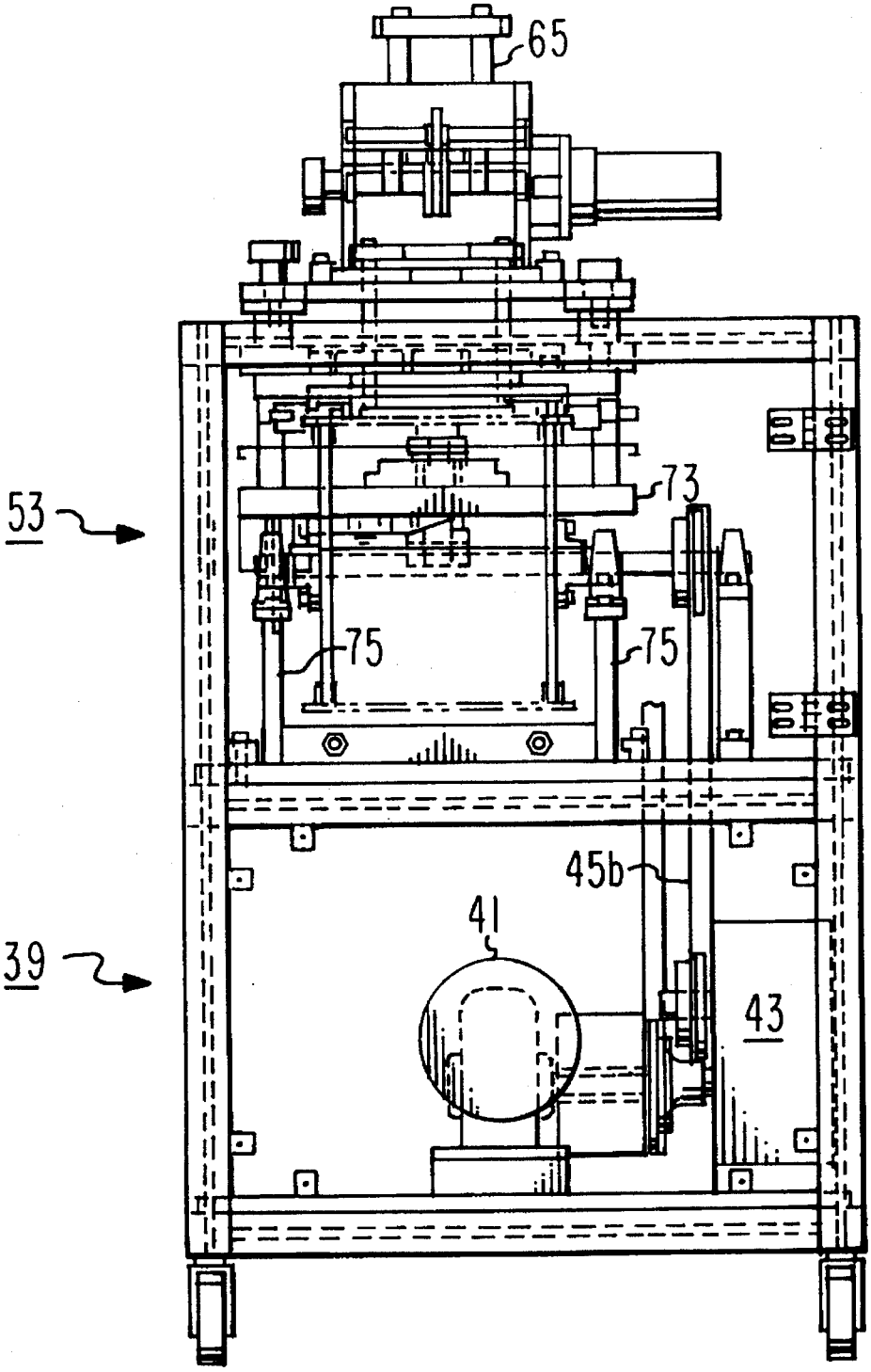
FIG. 3 is a right side elevation view of the machine taken as indicated in FIG. 2.
Figure 4:
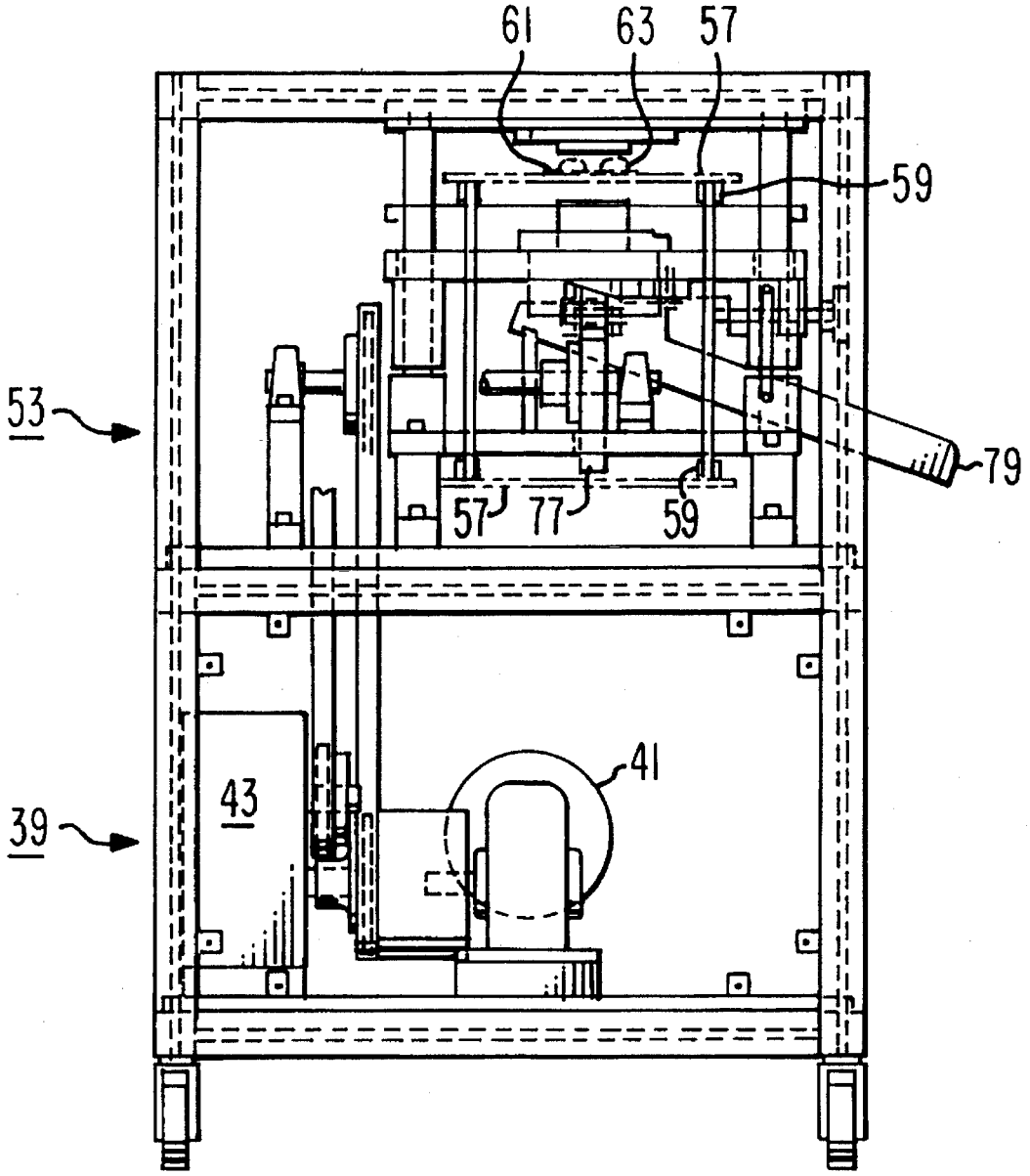
FIG. 4 is a left side elevation view of that portion of the machine below the magazine and taken as indicated in FIG. 2.

This structure can also be seen in the side view shown in FIG. 3 and FIG. 4. FIG. 3 shows a side view of the loading station 67, while FIG. 4 shows a side view of the punching station 51. Product is carried away from the punching station 51 by the chute 79 which extends from a point below the discharge of the punching station 51 to a point beyond the front face of the machine.

Figure 5:
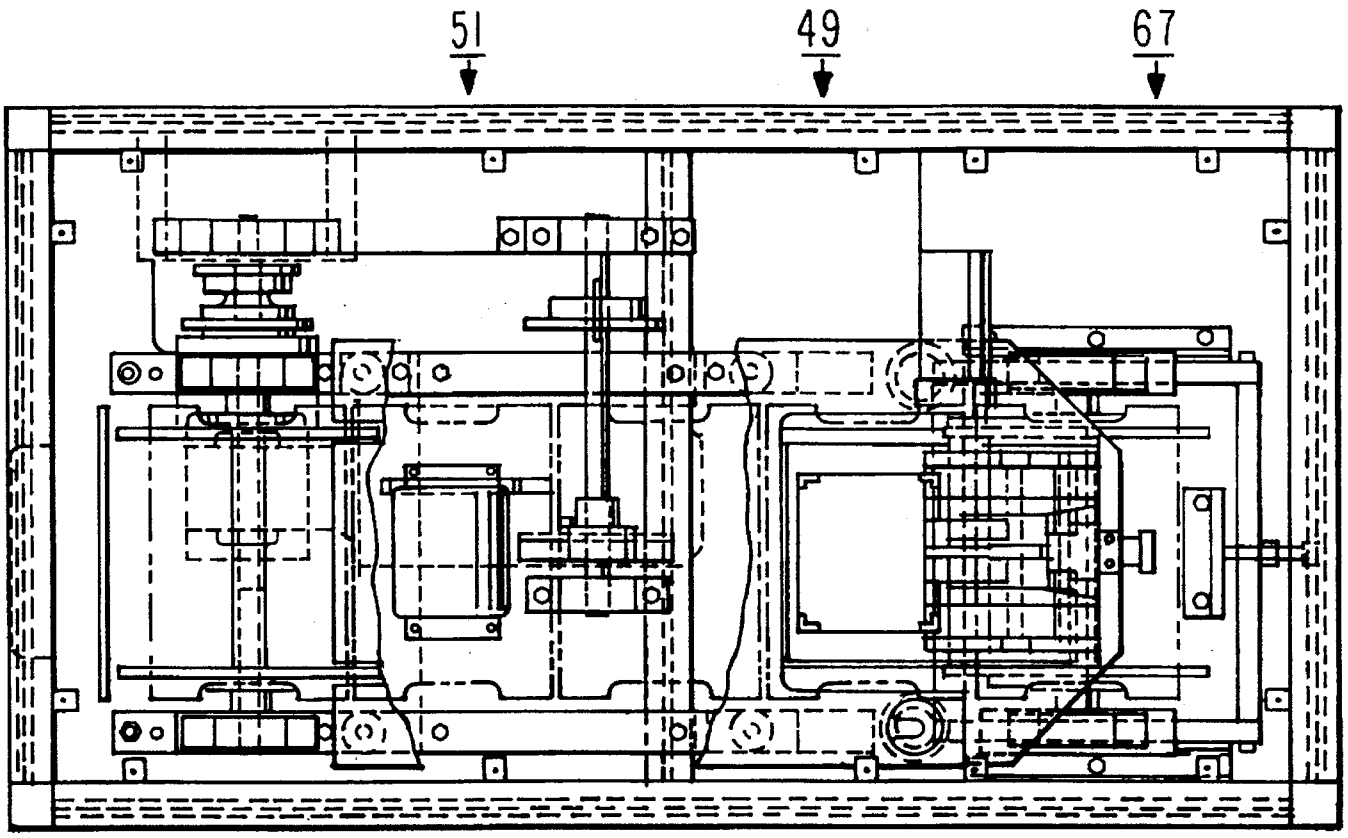
FIG. 5 is a plan view of the machine of FIG. 2.

FIG. 5, the plan view of the machine, shows that the loading station 67, the cutting station 49 and the punching station 51 are evenly spaced apart and evenly spaced along the length of the machine. In fact the distance between each station is equal to the length of one "index" of the conveyor 47 (slightly more than the length of a carrier plate 57).

FIG. 6 shows a side view, from the loading end, of the rib crimper 71 which as seen in FIGS. 2 and 3 is mounted to feed the magazine 65. The crimper 71 includes a pair of guides 81, FIG. 6*a*, to align a card with the male and female crimping wheels 83, 85, respectively. The crimping wheels 83, 85 rotate in counter rotation to positively drive a card there through. The female wheel 85 has a groove formed in its perimeter surface, while the male wheel 83 has an annular ridge to mate with the female wheel's groove. Then a card is pulled between the two wheels 83, 85, a rib shaped ridge is crimped into the back face of the card along its longitudinal center line. This straightens a curled card and allows it to lay flat. A second drive wheel 87 FIG. 6*a*, positioned before the crimping wheels 83, 85, pushes each card into these crimping wheels 83, 85.

Figure 7:
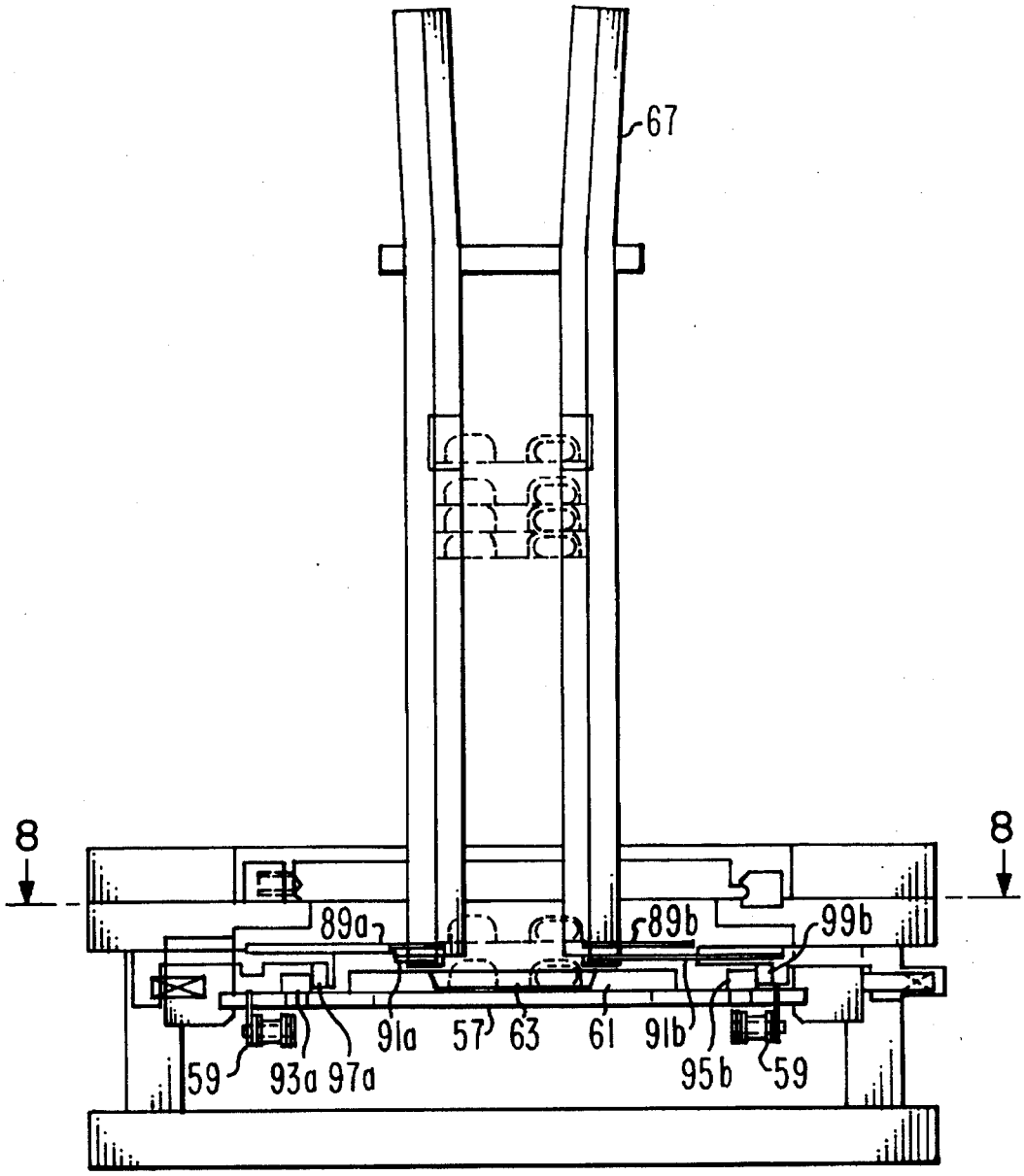
FIG. 7 is a side elevation view of the magazine and indexing station structure, with blister cards shown in phantom.

The structure and operation of the loading station 67 and its finger indexing subsystem 69 is seen in FIG. 7. The vertical magazine 67 can be slightly flared out at its intake end. A cross section of the conveyor, including its chain 59, a carrier plate 57, a nest plate 61 and a blister card 63 at rest at the loading station 67 is shown.

Two pairs of Juxtaposed fingers 89*a*, 89*b* and 91*a*, 91*b* are shown interrupting the path of blister cards 63 in the magazine stack 65 to the loading position of the nest plate 61. These finger pairs 89*a,b*, 91*a,b* are spring biased to the retracted position and the extended position, respectively. Two pairs of button type roller cams 93*a,b*, 95*a,b* are positioned on the upper face of each carrier plate 61 and interact with caming surfaces on the finger structure to cause them to move against their respective biasing. FIG. 7 shows button roller cam 93*a* engaging the cam surface 97*a* of the upper finger 89*a*, and button roller cam 95*b* engaging the cam surface 99*b* of the lower finger 91*b*.

Figure 8:
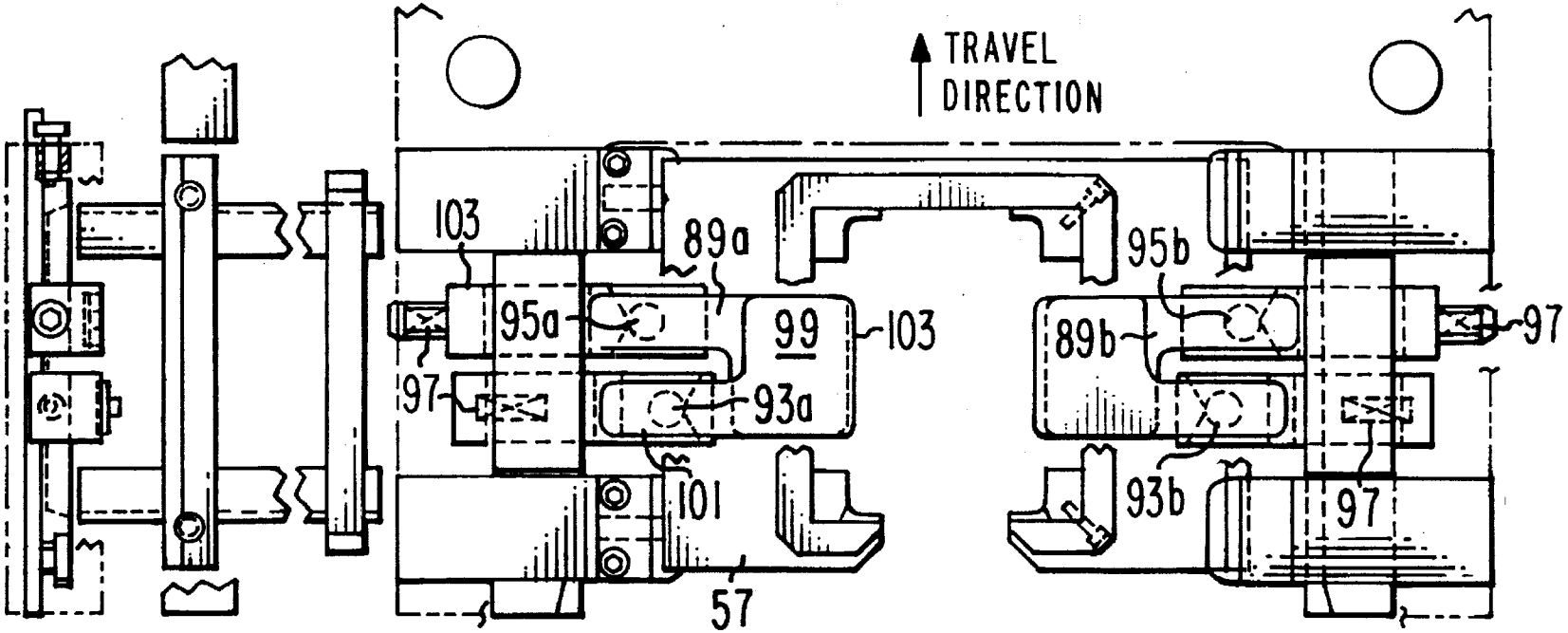
FIG. 8 is a cross sectional view of the indexing station structure taken as shown in FIG. 7.

FIG. 8 shows a detailed cross sectional plan view of the loading station 76 and the configuration of the finger pairs 89*a,b*, 91*a,b*. The carrier plate 57 carries the two pairs of button type roller cams 93*a*, 93*b* and 95*a*, 95*b*. The cams 95*a*, 95*b* which operate the lower fingers 89*a*, 89*b* are positioned slightly outboard and ahead (with respect to the direction of travel) of the cams 93*a*, 93*b* which operate the upper fingers 91*a*, 91*b*. Each finger pair is caused to operate against its respective spring 97.

Each finger of the finger pairs 89*a,b* and 91*a,b* has a wider blade portion 99 and a narrower tab portion 101. The blade portions meet the blister cards and have a tapered outer edge. Each portion 101 is removably mounted to a slider bar 103 which incorporates the caming surfaces 97*a*, 97*b*, 99*a*, 99*b* discussed above An connection with FIG. 8. The spring 97 biasing is mounted to operate directly on each slider bar 103 which translates to operating on the respectively mounted tab 101 of a respective finger 89*a*, 89*b*, 91*a*, 91*b*.

Each carrier plate 57, FIG. 9, has a cut out 105 along its opposing outside edges. Mounted to each cutout is a bracket shaped end drilled to mount into the links of the sprocket chain 59, FIG. 9*c*. The nest plate 61 which is carried upon the carrier plate 57 is attached by spring biased, quick release snap detentes 109 which force the nest plate against lip type catches 111.

Figure 10A:
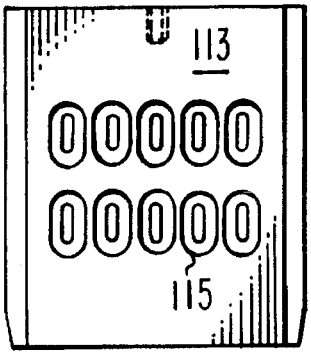
FIG. 10*a* is a plan view of the female die of FIG. 10 taken as shown in that figure.
Figure 10C:
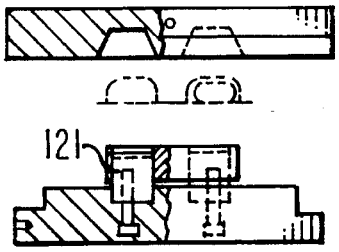
FIG. 10*c* is a partial cut away enlarged detail of the cutting plate and female die of FIG. 10.

The male end members which perform the cutting at the cutting station 49 are shown in FIGS. 10, 10*a*, 10*b* and 10*c*. The stationary female die 113, contains a plurality of truncated tapered holes of a position and size to receive the blister pocket structures 117, one each, of a blister card 63. The regular and repetitive pattern of these holes is seen in FIG. 10*a*. The cutting plate 119 supports the plurality of individual cutting knives 121 used for cutting through the back of a card 63. These cutting knives allow for give and misalignment with the tapered female die 115 openings 117 when the two dies are brought together. A spring loaded stripper mechanism assures that the card 63 does not move when in position to be cut and strips the blades 121 from the card 63 back face when the blades 121 are withdrawn. FIG. 10*c* shows a cross sectional enlargement of the mounting screws for each knife which as shaped in a U shape to produce a cut flap. The knives 121 for the machine are easily removable and exchangeable as are all of the blister card interfacing/interacting components of the machine.

Figure 11A:
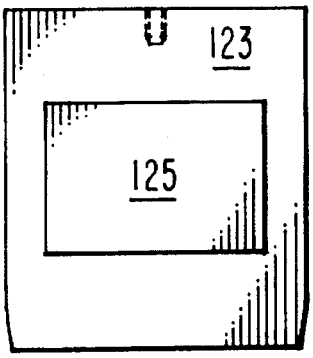
FIG. 11*a* is a plan view of the knock out of FIG. 11 taken as shown in that figure.
Figure 10:
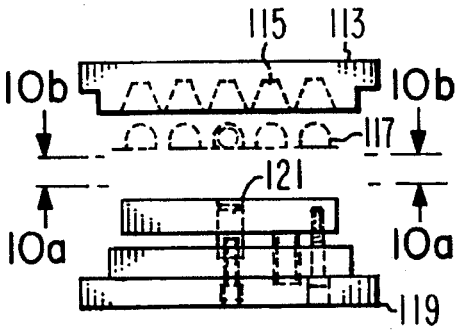
FIG. 10 is a detailed side view of the cutting station cutting plate and female die with a blister card and product shown in phantom.
Figure 11:
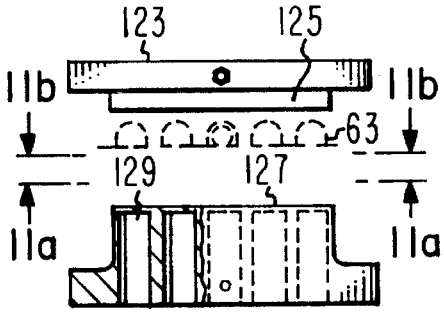
FIG. 11 is a detailed side view of the knock out and female die assembly for the punching station with a blister card and product shown in phantom.
Figure 10B:
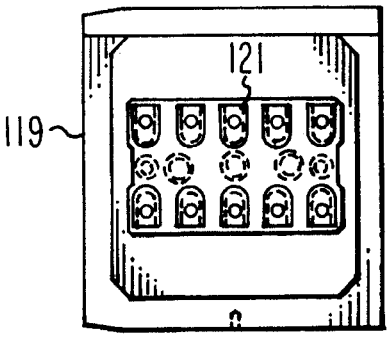
FIG. 10*b* is a plan view of the cutting plate of FIG. 10 taken as shown in the figure.
Figure 11B:
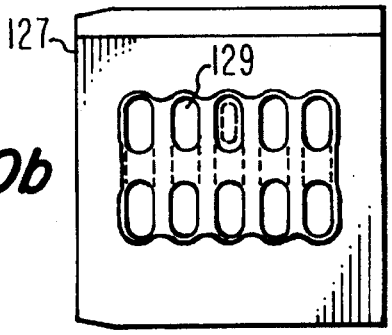
FIG. 11*b* is a plan view of the female die of FIG. 11 taken as shown in that figure.

FIG. 11, 11*a* and 11*b* show the male and female members which perform the punching operation at the punching station 51. A fixed position knock out plate 123 carries a rectangular knock out bar 125 on its surface, FIG. 1, 111. This knock out 125 simultaneously pushes down on each blister pocket as the movable female die is raised to intercept a card 63 and push it into the knock out 125. This action forces each product unit through the flap previously cut in the back face of the card 63 and downwardly through a respective one of the passageways of ports 129 of the female die 127. It is to be understood that the size and location of these ports 129 are established to accommodate the movement of product without injury to the product itself, or the binding or jamming of product against the surfaces of the machine as illustrated in FIG. 11*b*.

Figure 12A:
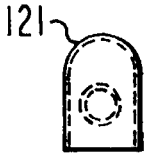
FIG. 12*a* is a plan view of a perforation knife for the cutting plate shown in FIG. 10*b.
Figure 12B:
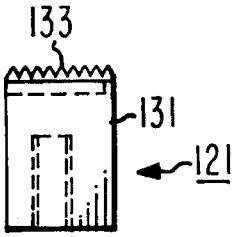
* and FIG. 12*b* is side view of the knife of FIG. 12*a*.

Each knife 121 has a U shaped profile, FIG. 12*a*, and includes a base member 131 and a serration member 133 having perforation teeth.

The dimensions of the various elements of the invention will vary depending upon the specific blister card and specific product being handled. Therefore, the design has incorporated numerous "change parts" which are easily accessed without the extensive disassembly of the machine.

The present invention provides an improved machine over the prior art. This improvement is realized in greatly enhanced speed (capacity), increased reliability and reduced product, damage and jamming, and reduced maintenance and change over time. This has been accomplished by reducing the number of moving parts, the timing requirements for synchronizing the various operations of the machine and the physical spreading out to various locations of the sequential operational steps of the machine. All movement of product is simple straight line. Additionally, the invention incorporates the opening of a blister pocket by cutting through the back face of the card where the spacing is greatest and the likelihood of damaging the product is least. The incorporation of simple direct drive conveyor positioning and the incorporation of mating die members having tapered surfaces assists in the proper alignment of elements and allows for the accurate "blind" cutting into the blister pocket from the back side.

The above described embodiment(s) are intended to be an example of the invention, which may be implemented in additional ways to those discussed above without departing from the scope and intent of the invention. It is therefore intended that the above description be read as illustrative of and not taken as limiting the invention.

What is claimed is:

1. A method of recovering pharmaceutical product from blister pack cards, said cards each having a top face with at least one blister product pocket extending outwardly therefrom and a back face, comprising the steps of:

establishing a transport plate for holding each said blister pack card and controlling the orientation thereof while said blister pack card and said blister product packet thereof are operated upon;

feeding said cards, each held by a said transport plate, individually and sequentially to a cutting station;

at said cutting station, cutting through the back face of said card, oriented by said transport plate, at each blister product pocket location, simultaneously;

moving said cut card oriented by said transport plate to a punching station;

at said punching station, simultaneously forcing each said product out of its respective pocket of said cut card by punching downward on each said blister thereby crushing it and pushing said product held therein through said cut back face to free said product of said card structure while said card is oriented by said transport plate;

collecting said freed product; and collecting said emptied card as waste from said transport plate.

2. The recovery method of claim 1 where before the step of feeding, includes:

straightening each card to lay flat; and stacking said straight cards in a magazine feeder.

3. The recovery method of claim 2 wherein said feeding step stacking is stacking a plurality of said straight cards in said magazine feeder and wherein said feeding step also includes the steps of:

gating said bottom most card in said magazine stack, individually, onto said transport plate, wherein said transport plate forms part of a conveyor structure;

inhibiting any remainder of said stacked straight cards in said magazine feeder stack from moving from said magazine feeder stack; and moving said conveyor structure to cause said card to be positioned in said cutting station.

4. The recovery method of claim 3 wherein said step of cutting through the back face of said card includes the steps of:

establishing a plurality of cutting devices in a matrix array of the product blister pockets of said card;

providing each said cutting device with the ability of cutting an opening through said card back face which is slightly larger than the size of said product;

holding said card fixedly flat from said blister pocket side while said card is cut; and simultaneously cutting through said card back face at the location of each blister pocket while said card is held fixedly flat.

5. The recovery method of claim 4 wherein the step of simultaneously forcing product out of its pocket through said back face includes the steps of:

holding said card fixedly flat while allowing an unobstructed path away from each of said back face cut through locations; and simultaneously compressing each said blister pocket towards the back face thereby forcing said product through said cut back face cut through.

6. The recovery method of claim 5 wherein the step of cutting through the card back face leaves a cut flap of back face material which remains laying contiguous with the back face, said flap being of sufficient strength to retain the product in said card while said card is moved from said cutting station to said punching station; and wherein when said product is forced through said back face cut through said flap pivots to readily allow the passage of said product.

7. The recovery method of claim 6 wherein the step of straightening each card to lay straight includes the step of crimping said card back with a rib shape.

8. An apparatus, having a cutting station and a punching station, for recovering pharmaceutical product from blister pack cards, said cards each having a back face and a plurality of blister product pockets extending upwardly from said back face in a pattern to form a top face of said card, and pharmaceutical product held in said blister pockets, comprising:

a retention structure for holding a quantity of said blister cards from which product is to be recovered;

an indexing structure for selecting single ones of said blister cards from said retention structure and feeding same;

a conveyance structure including a plurality of nest plates each having an opening therethrough for receiving said singly fed blister cards from said indexing structure and for conveying same in single sequential and predetermined order first to a cutting station and then to a punching station;

a plurality of cutter structures, establishing said cutting station, and aligned consistent with said pattern of the product blister pockets on said card and operable to cut a flap through said back face at the location of each said product pocket when a said card is aligned with said cutting station, said cutter structures operating through each said nest plate opening;

a knock out structure, establishing a punching station, and operable to simultaneously push each of said product units through its respective cut flap when said card is aligned with said punching station thereby emptying said card of said product, whereof a die member is lowered onto each said blister pocket collapsing it and pushing said product downward through said cut back face, said knock out structure operating through said each said nest plate opening;

a collection structure for receiving said emptied product, being positioned adjacent said punching station; and a discharge structure wherein said conveyance structure is manipulated for each nest plate to discharge each said emptied card.

9. The apparatus of claim 8 also including a crimping structure for crimping a longitudinal rib into the back face of a blister card, said crimping structure being connected to said retention structure.

10. The apparatus of claim 9 also including a central drive mechanism with a direct drive connection to said conveyance structure, to said plurality of cutter structures and to said knock out structure, wherein the timing of operations of said machine are centrally controlled.

11. The apparatus of claim 10 wherein said conveyance structure is a continuous sprocket chain conveyor comprised of a plurality of conveyance sections linked together and oriented to have an operations section which runs essentially horizontally, said chain conveyor movement being driven by a connection from said central drive mechanism.

12. The apparatus of claim 11 wherein each conveyance section of said chain conveyor includes a rectangular carrier plate connected between said sprocket chains defining a belt, said carrier plate having a relatively large central rectangular opening surrounded by a plate margin; wherein each respective said nest plate is positioned on a respective individual rectangular carrier plate of a respective conveyance section; and wherein said indexing structure for selecting and feeding single ones of said blister cards is spring biased to a first position and cam operated to a second position; and wherein a caming structure for operating said indexing structure is positioned on each carrier plate margin.

13. The apparatus of claim 12 wherein said retention structure is a magazine having an intake end and an output end, said magazine output end being positioned adjacent said indexing structure; and wherein said blister cards are held in said magazine in like orientation.

14. The apparatus of claim 13 wherein said indexing structure includes two pairs of juxtaposed blade type fingers, positioned to laterally operate across the output end of said magazine, said first finger pair operating to hold and then release a blister card, said second fingered pair operating to release and then hold a blister card, whereof this positioning of said two pairs of fingers operates to isolate and feed a card appearing at said magazine output end.

15. The apparatus of claim 14 wherein said first and second juxtaposed finger pair lateral operation includes movement between an extended position and a retracted position wherein said first juxtaposed finger pair is biased to the extended position, and each said first finger carries a caming surface which controls the retraction of said first fingers against said biasing and said second juxtaposed finger pair is biased to the retracted position and each said second finger carries a caming surface which controls the extension of said second fingers against said biasing; and wherein each said conveyor carrier plate margin carries two sets of roller type cams, the first set of roller cams operating against said first finger pair caming surfaces and the second set of roller cams operating against said second finger pair caming surfaces, whereby the movement of said conveyor and its successive carrier plates operates said indexing finger pairs.

16. The apparatus of claim 15 wherein each said nest plate carried by its respective carrier plate is positioned over said carrier plate opening, each said nest plate having a recessed opening of a size and shape to hold a blister card about its edges.

17. The apparatus of claim 16 wherein said plurality of cutter structures includes: a knife base plate; a plurality of U shaped perforation knives having perforation teeth and mounted to extend from said knife base plate and positioned to correspond to the positions of said blister pockets on a blister card, said knives each being shaped to cut a radius line at the open end of the U shape; a female die plate having a plurality of tapered holes of a number and position to correspond to the positions of said blister pockets on said blister card for cradling said blister pocket projections above said blister card; wherein said female die plate is fixedly positioned above said chain conveyor at said cutting station; and wherein said perforation knives operate from below said plane of said chain conveyor to travel through the opening in said nest plate thereby moving said blister card off said nest plate and onto said female die, said perforation knives traveling further into the back face of said card to extend into said pocket space, thereby cutting a flap in said back face, said perforation knives thereafter retracting through said nest plate opening carrying said card away from said female die and back into said nest plate recess opening.

18. The apparatus of claim 17 wherein said knock out structure includes: a male die and a female die, said male die being fixedly positioned above the plane of the chain conveyor at said punching station and including a base plate and at least one knock-out surface protruding from said base plate a distance sufficient to compress said blister pockets and to force said product through said back face cut flap opening, said protruding knock out surface being of a shape and size corresponding to the blister pattern on said card; said female die being a movable plate having a plurality of through holes corresponding one each to each product position on said blister card, said through holes being of a size and shape to pass said product units, said movable plate also presenting a stop surface for seating against said mating male die base plate; wherein said movable plate operates from below said plane of said chain conveyor to travel through the opening in said nest plate thereby carrying said blister card off said nest plate and onto said knock out structure male die, thereby effecting the punch out of said product from said card.

19. The apparatus of claim 18 also including a shuttle plate structure having: a vertical guide rod structure positioned below said chain conveyor adjacent said cutting station and said punching station, a support shuttle plate mounted to slide on said guide rod structure and extending beneath said chain conveyor at said cutting station and said punching station, a shaft mounted rotating cam operating against said shuttle plate bottom and causing it to reciprocate on said guide rod structure towards and away from said cutting station fixed female die plate and said punching station fixed male die, said cutting station knife base plate and said punching station female die plate being mounted on said shuttle plate for simultaneous operation; wherein said shuttle plate has openings therethrough to allow for the passage of product out of said punching station female die plate.

20. The apparatus of claim 19 wherein said crimping structure includes a first roller having a concave groove in its perimeter surface, a second roller having a friction knurled perimeter surface of a width to mate with said first roller groove, said second roller being driven to rotate in counter rotation to the first roller thereby carrying a blister card therethrough and deforming the back face of said card with a raised elongate groove being a reinforcing rib.

* * * * *

UNITED STATES PATENT AND TRADEMARK OFFICE

CERTIFICATE OF CORRECTION

PATENT NO. : 5,509,773
DATED : April 23, 1996
INVENTOR(S) : John J. Connor and Klaus E. Gehlert It is certified that error appears in the above-indentified patent and that said Letters Patent is hereby corrected as shown below:

Abstract: line 18: change end to and;

Col. 2, line 2: change technically to mechanically;
Col. 2, line 5: change "wargin" to "margin";
Col. 2, line 9: change Bade to made;
Col. 4, line11: change end to and;
Col. 4, line47: Change Moth to both;
Col. 4, line57: change An to in;
Col. 4, line59: change end to and;
Col. 6, line 7: change end to and;

Col. 7, line49: change end to and;
Col. 8, line 9: change FIG 111 to FIG1, 11a.

Signed and Sealed this

Third Day of September, 1996

*Attest:*

*Attesting Officer*

BRUCE LEHMAN

*Commissioner of Patents and Trademarks*